US009539719B2

(12) United States Patent
Geibel

(10) Patent No.: US 9,539,719 B2
(45) Date of Patent: Jan. 10, 2017

(54) LOCKING, REVERSIBLE BLADE SCREWDRIVER

(71) Applicant: Ronald James Geibel, Schaumburg, IL (US)

(72) Inventor: Ronald James Geibel, Schaumburg, IL (US)

( * ) Notice: Subject to any disclaimer, the term of this patent is extended or adjusted under 35 U.S.C. 154(b) by 326 days.

(21) Appl. No.: 14/485,404

(22) Filed: Sep. 12, 2014

(65) Prior Publication Data

US 2015/0096414 A1 Apr. 9, 2015

Related U.S. Application Data

(60) Provisional application No. 61/888,673, filed on Oct. 9, 2013.

(51) Int. Cl.

| | |
|---|---|
| ***B25G 1/08*** | (2006.01) |
| ***B25B 15/00*** | (2006.01) |
| ***B25B 23/00*** | (2006.01) |
| ***B25G 1/06*** | (2006.01) |

(52) U.S. Cl.
CPC ..... *B25G 1/085* (2013.01); *B25B 15/00* (2013.01); *B25G 1/063* (2013.01)

(58) Field of Classification Search
CPC ..... B25G 1/085; B25G 1/063; B25G 1/04; B25G 1/043; B25G 3/12; B25G 3/24; B25G 3/28; B25B 23/0042; B25B 23/0007
See application file for complete search history.

(56) References Cited

U.S. PATENT DOCUMENTS

| | | | | |
|---|---|---|---|---|
| 6,029,549 | A * | 2/2000 | Baker | B25B 15/02 81/177.4 |
| 6,494,121 | B1 * | 12/2002 | Hu | B25B 15/02 81/438 |
| 8,047,102 | B2 * | 11/2011 | Gnatz | B25B 13/06 7/165 |
| 8,621,961 | B2 * | 1/2014 | Burch | B25B 15/02 7/107 |
| 8,856,994 | B2 * | 10/2014 | Powers | B25B 15/00 7/107 |
| 9,056,392 | B2 * | 6/2015 | Anderson | B25G 1/085 7/164 |
| 2015/0241475 | A1 * | 8/2015 | Anderson | B25G 1/085 324/556 |

* cited by examiner

*Primary Examiner* — David B Thomas

(57) ABSTRACT

A locking, reversible blade, screwdriver is provided. The screwdriver incorporates a reversible blade; one end is a flat blade for latches or any application that requires a durable flat blade screwdriver, the opposing end is a drive bit holder which could be a magnetic bit holder, C clip bit holder, ball type bit holder etc., or any combination which will accept a variety of drive bit types. The blade can be inserted into the handle with the desired end exposed, where it is secured in place with a ball lock. One hand digital intervention releases the blade. A threaded removable end cap at the opposite end of the handle exposes a selector. This selector, when rotated allows access to one of several tubes holding drive bits for the bit holder end of the blade. The end cap has a wide comfortable flat base with a perimeter recess which acts as a finger grip and the flat base allows the screwdriver to sit on its end for one handed fastener loading on a drive bit.

7 Claims, 4 Drawing Sheets

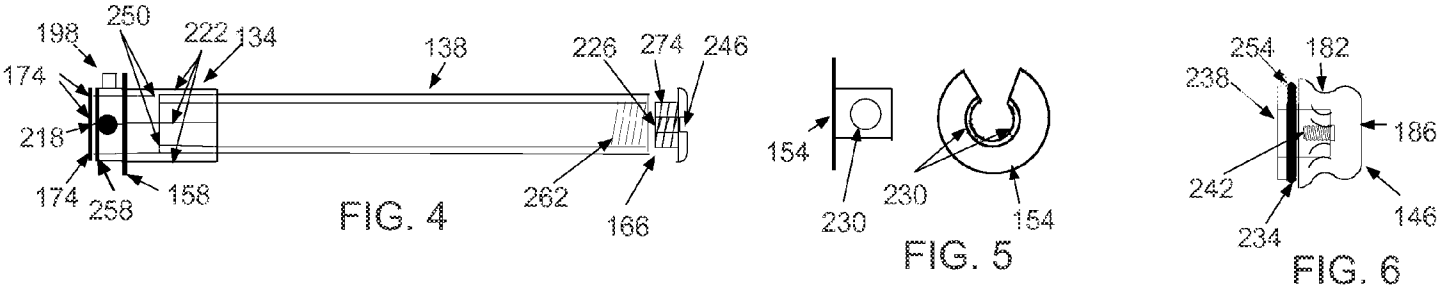
FIG. 6
FIG. 5
FIG. 4
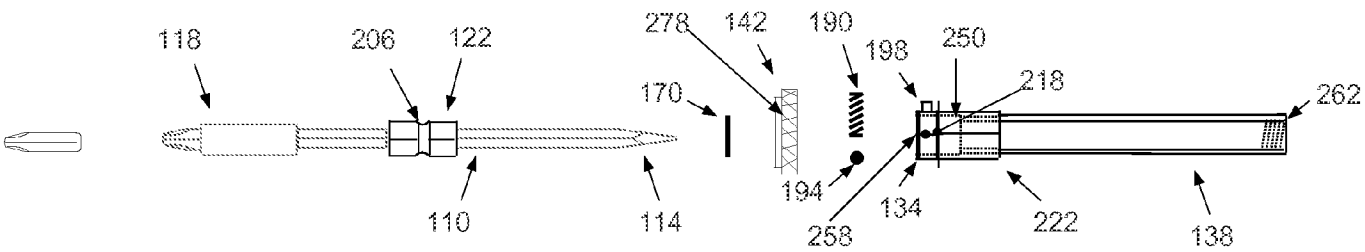
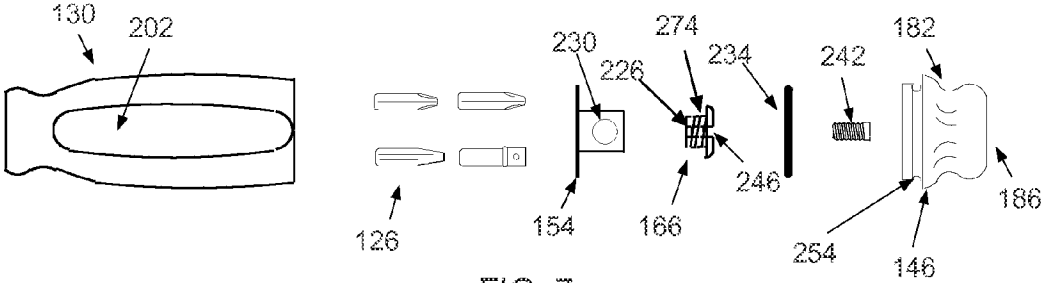
FIG. 7

LOCKING, REVERSIBLE BLADE SCREWDRIVER

FIELD OF INVENTION

This invention relates to screwdriver-type hand tools. More particularly to a screwdriver with a locking reversible blade. One end having a bit holder for drive bits, the opposing end having a flat blade for driving straight slot fasteners or opening latches. The blade is locked in the handle with the desired end exposed and removal requires digital intervention.

BACKGROUND OF INVENTION

There been many prior art patents related to screwdrivers. Some fixed blade screwdrivers, some reversible blade screwdrivers and some screwdrivers with bit holding mechanisms, where a variety of different tips will insert into the bit holder making the screwdriver very versatile. The problem is there are many applications where a durable flat blade screwdriver is required along with the versatility of the bit holder screwdriver. One example, though there are many, would be in the aviation industry. Mechanics are required to work with many fasteners such as, Phillips, straight slot, Tri wing, Torque, Airbus, Allen and etc., which are all in various sizes. The drive bit holder screw driver which accepts these drivers is a required tool. On the other hand the mechanic is also required to open many latches such as on oil service doors, engine cowlings, engine pylon panels, fuselage panels, as well as wing and tail panels. These latches are designed to be opened with a flat blade screwdriver and cannot be opened with a bit holder screwdriver. These latches place a spring loaded grip on the blade as the latch is pried open. For this reason the blade must be firmly seated in the handle, so as not to dislodge when the blade is removed from the latch. Thus, with tool space being limited, the mechanic is required to carry two screwdrivers to accomplish his task.

Other devices which incorporate a duel end blade include U.S. Pat. No. 1,552,361 to Trombley. This patent provides a rotating, locking, dual purpose blade but does not have a drive bit holder or bit storage and the handle will not support other tools.

Another type of screwdriver mechanism with a duel end blade is U.S. Pat. No. 4,590,824 to Cushman which also rotates but does not offer a positive handle lock, drive bit holder or bit storage.

Yet another duel tipped screwdriver is U.S. Pat. No. 4,776,246 to Elliston showing an anti-rotating device, but also does not offer a, positive handle lock, a drive bit holder, drive bit storage, drive bit storage selector etc.

BRIEF SUMMARY OF INVENTION

Among the many objectives of this invention is the provision of a locking reversible flat blade/drive bit screwdriver. It affords the user the ability to have one screwdriver which will accept many different drive bits and offers a flat blade screwdriver to open latches or any other job where a flat blade is needed.

A further objective of this invention is to provide a positive lock for the blade in the handle that will require one hand digital intervention to remove.

Another objective of this invention is to provide drive bit storage, where the user selects only the drive bits needed.

An additional objective of this invention is to provide a finger grip on the end cap for easy removal from a tool pouch.

Yet another objective of this invention is to provide a comfortable end cap for putting pressure on tight fasteners, which will also allow the screwdriver to stand on its end in confined areas, affording one hand fastener loading on the drive bit.

Still another objective of this invention is to provide a durable high quality locking handle which can be used with any tool equipped with this inventions ball lock adapter, such as a file holder, saw blade, scraper, tap, reamer and etc.

BRIEF DESCRIPTION OF THE DRAWINGS

FIG. 4 is a side view of the blade housing of FIG. 1 which is retained by the handle. From the left it exposes a hex ball lock housing which receives the hex ball lock adapter on the screwdriver blade, spring stop, ball hole, a raised flange stop, an external hex to prevent rotation in the handle, the hex ball lock adapter stop and a threaded end fitting on the opposing end;

FIG. 5 is a side and end view of the rotating bit tube selector of FIG. 2B; showing finger grip holes in each side;

FIG. 6 shows a side view of the handle end cap of FIG. 1 with a threaded male stud which attaches the end cap to the blade housing fitting. Also revealed is the "O" ring seal;

FIG. 7 is an exploded view of all parts of FIG. 1;

DESCRIPTION OF THE PREFERRED EMBODIMENT

Figure 1:
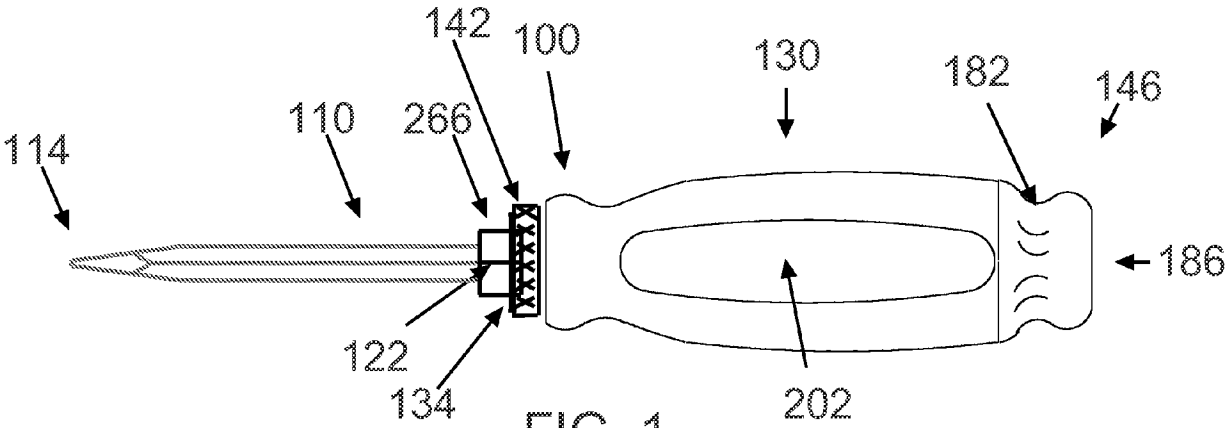
FIG. 1 is a side elevation view of one embodiment of the locking, reversible, flat blade/drive bit screwdriver where the blade locks into the handle and can be reversed to expose the desired flat blade or drive bit holder end.
Figure 1A:
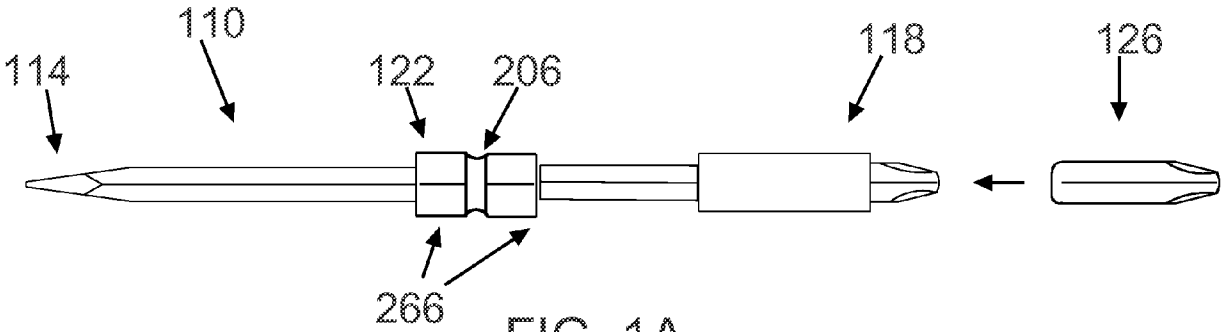
FIG. 1A shows a side view of the reversible blade, with a flat blade on one end, drive bit holder on the opposing end and a hex ball lock adapter in the center.

Referring now to the drawings FIGS. 1 through 9, one embodiment of the locking, reversible, flat blade/drive bit screwdriver 100 is shown. The screwdriver includes a handle 130, reversible blade 110, a flat blade end 114, and an opposing drive bit holder end 118 which receives drive bits 126. The blade also displays a hex ball lock adapter 122, which incorporates a ball lock channel 206. Male hex 266 prevents rotation in the ball lock housing 134 which has a female hex 174. Blade 110 in the drawings is shown as a hex but functions as well if round or square.

Handle 130 houses a one piece blade housing 138 shown in FIG. 4 which incorporates a ball lock housing 134. The ball lock housing has a lock ball hole 218, located at one of the internal hex points, a stop 198 for the rotating ball lock sleeve and spring along with retaining clip channel 258. In addition there is a raised flange 158. The raised flange covers the locking mechanism when assembled. Inside the ball lock housing 134 is a hex 174 to prevent rotation of the blade ball lock adapter 122. Stop 250 limits the adapters travel. The perimeter of ball lock housing 134 receives the rotating ball lock sleeve 142 along with its spring 190 ball 194 and sleeve retaining clip 170. Rotating ball lock sleeve 142 has a textured gripping surface 278. An external portion of the ball lock housing is a hex 222 to prevent rotation in the handle. Being square, scalloped, finned, etc. would just as well serve this purpose.

Figure 3B:
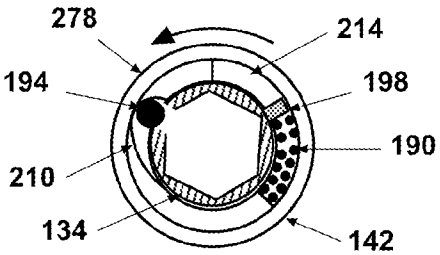
FIG. 3B demonstrates the ball lock on screwdriver handle of FIG. 1 deposed in the unlocked position by digital intervention.
Figure 3A:
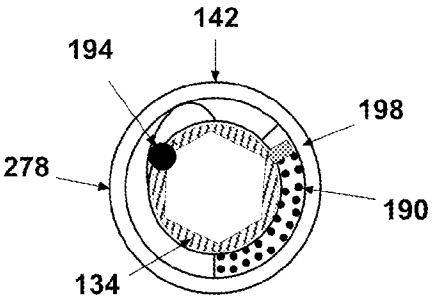
FIG. 3A demonstrates how the ball lock on screwdriver handle of FIG. 1 operates with the selector sleeve, ball and spring in place on the hex ball lock housing, showing the ball deposed in the locked position by spring pressure.
Figure 3:
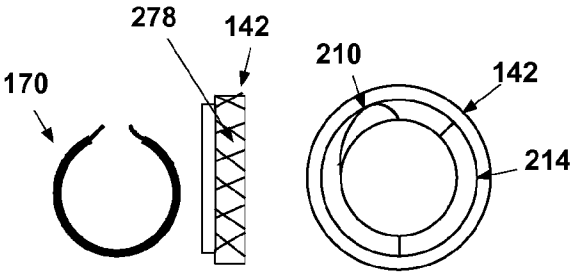
FIG. 3 is a right side end view of the ball lock selector sleeve, of the screwdriver handle of FIG. 1 showing the cut out for the spring and stop, as well as the tapered lock ball cam cut out. Also showing on the left is the snap ring which retains the ball lock selector sleeve on the hex ball lock housing.

FIG. 3 shows the rotating ball lock sleeve, spring and stop cut out 214 as well as at least one lock ball cam cut out 210. Also shown in FIG. 3 is the rotating sleeve retaining clip 170. FIG. 3A is a cut away view of rotating ball lock sleeve 142 in place over the hex ball lock housing 134 with ball 194 and spring 190 in place. This depiction shows the ball in the locked position by spring pressure. FIG. 3B depicts the ball in the unlocked position by digital intervention, with the ball acting as the stop in the unlock direction. If a smaller ball is used an additional stop could be added for this purpose.

Figure 2B:
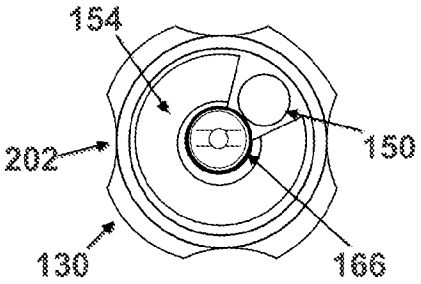
FIG. 2B is a right end view of the screwdriver handle of FIG. 1 with the rotating bit tube selector in place. It also shows the threaded blade housing end fitting installed, which the screwdriver end cap threads into.
Figure 2A:
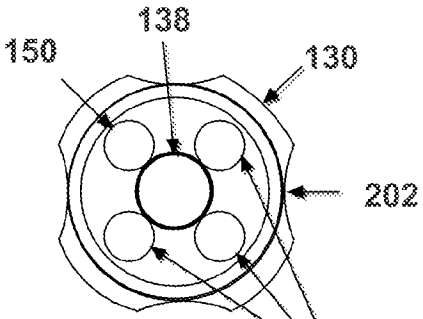
FIG. 2A screwdriver handle of FIG. 1 with the end cap removed. It exposes the round blade housing in the center and four drive bit storage tubes in a recessed area around the perimeter.
Figure 2:
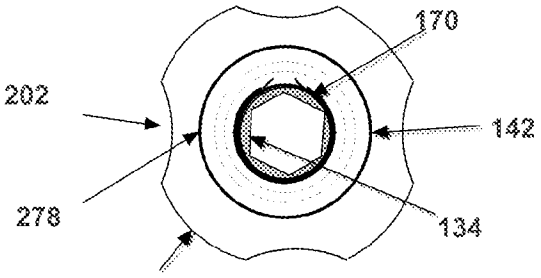
FIG. 2 is a left end view of the screwdriver handle of FIG. 1 showing the hex ball lock housing and the rotating ball lock sleeve.

FIG. 2 shows the ball lock end of handle 130 assembled with retaining clip 170 in place.

FIG. 2A Handle 130 end cap view with end cap 146 removed reveals four concave grip recesses 202 four drive bit storage tubes 150. FIG. 2B shows the same view as FIG. 2A with the rotating bit tube selector 154 and blade housing end fitting 166 in place.

Figure 8:
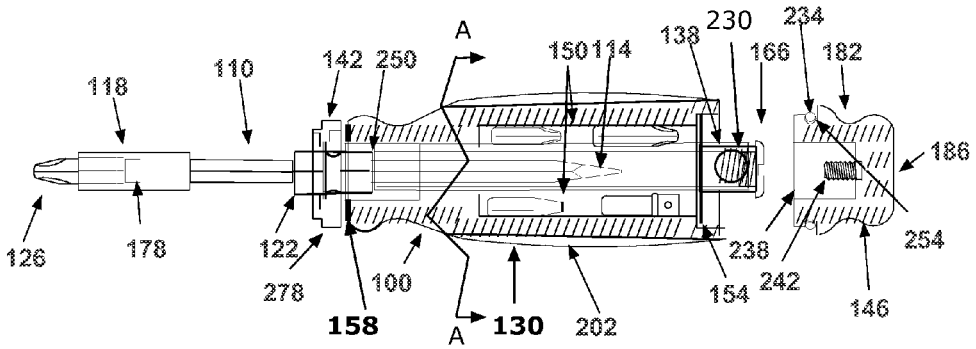
FIG. 8 is a cutaway view of the screwdriver of FIG. 1 with the bit holder blade end selected and the handle end cap removed.
Figure 8A:
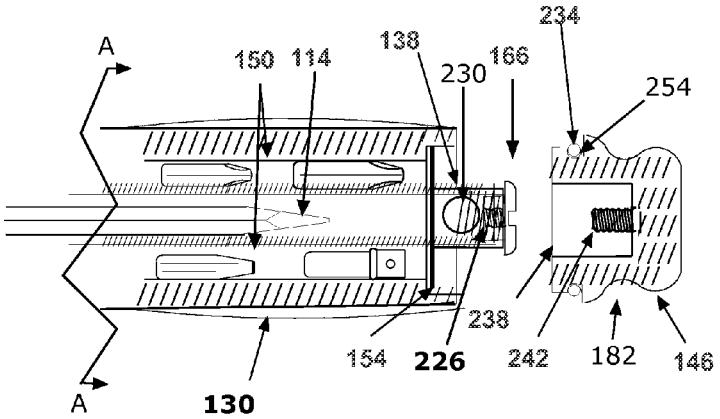
FIG. 8A is enlarged section view of FIG. 8 showing end cap and bit storage area of the screwdriver in FIG. 1.

FIG. 8A in this sectioned, cutaway view, the end of blade housing 138 can be seen extending past the end of the handle 130. This portion of blade housing 138 with its female threads serves several functions. It is the pivot for the rotating bit selector 154. It in addition it accepts the blade housing 138 end fitting 166 with its male external threads 274, female internal threads 226, and head with securing slot 246 which retains the rotating bit selector 154.

End cap 146 shows an "O" ring groove 254, a recess 238 for the blade housing 138 and a male stud 242 which allows the end cap 146 to thread onto blade housing end fitting 166. End cap 146 also has a finger grip 182 for easy removal from a tool pouch; in addition it has a proportionally large flat base 186 for one hand fastener loading, and offers hand comfort when removing tight fasteners. "O" ring 234 seals the end cap.

FIG. 7 shows an exploited view of all parts of this invention as they would be assembled.

FIG. 8 is a cutaway depiction of the Locking, reversible blade screwdriver 100 with the drive bit holder exposed. The drive bit holder is shown using the preferred magnetic drive bit retainer 178. The end cap is removed providing a view of one of the grip holes 230 in the rotating drive bit selector and the blade housing 138 end fitting 166.

Figure 9:
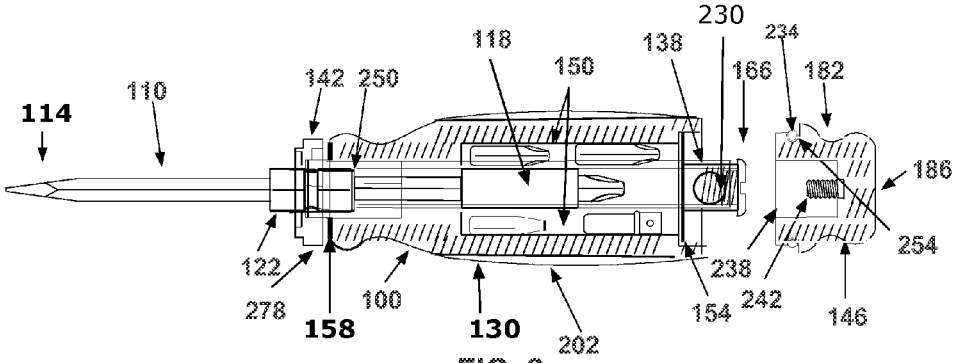
FIG. 9 is a cutaway view of the screwdriver of FIG. 1 with the flat blade end selected.

FIG. 9 is the same view of screwdriver 100 as FIG. 8 with the flat blade 114 exposed.

Having thus described the preferred embodiment, the invention is now claimed to be:

1. A screwdriver with drive bit storage and a locking, reversible blade, one end of the blade is a hexed drive bit holder, which incorporates a drive bit retainer such as a magnet, "C" clip, spring clip and ball, etc., alone or in combination to retain drive bits, the opposing end is a flat blade, in the center of the blade is a hex ball lock adapter having a ball lock channel, the handle incorporates a blade housing having ball lock housing with a least one ball hole, stop, retaining clip groove and flange on its perimeter, the ball lock housing is surrounded by a rotating ball lock sleeve, this rotating sleeve has a griping surface on it perimeter, a cutout for a stop and spring and at least one lock ball cam cutout, the rotating sleeve is held in place by a retaining clip while the flange covers it contents, a spring and at least one ball, spring pressure keeps the a ball depressed into a hole in at least one of the lock ball adapter's hex points through the ball lock cam, this spring pressure keeps the ball locked in the ball lock channel on the blade ball lock adapter, one hand digital intervention allows the rotating ball lock sleeve to release the ball or balls for removal or insertion of the blade, this allows the blade to be positively locked in the handle until digital intervention allows for its removal.

2. The screwdriver in claim 1 further comprising: A handle with drive bit storage tubes under its end cap, 4 drive bit tubes preferably, but could be more or less, the blade housing extends past the end of the handle's cap end, bit tubes are formed around the blade housing handle recess, the female threads in the end of the blade housing allow an end fitting with male threads to thread onto it, this end fitting in addition has a slot for securing and internal female threads, a male stud on the end cap allows the cap to be secured in place on the handle by threading into the blade housing end fitting.

3. The screwdriver in claim 1 further comprising: A drive bit storage area in the cap end of the handle further characterized with a rotating bit tube selector having grip holes on its side and positioned around the end of the blade housing over the bit tubes, this selector has a cutout on its flat surface which allows the bit tube selector when rotated to expose only one bit tube at a time, the bit tube selector is secured by the head of the blade housing fitting.

4. The screwdriver in claim 1 further comprising: A handle exterior with concave grips down a portion of its length, an end cap with "O" ring channel and "O" ring where it mates with the handle, a large rounded flat surface end cap with a recessed perimeter which affords a grip area.

5. The screwdriver in any one of claims 1 through 4 further comprising: The handle without the blade, to be used with any tool fitted with this invention's ball lock adapter.

6. The screwdriver in claim 1 further comprising a reversible blade, one end being a flat blade and the opposing end comprising a drive bit holder with the center of the blade having an anti-rotation device with a ball lock groove.

7. The screwdriver in claim 1 further comprising a reversible blade, one end being a flat blade and the opposing end comprising a drive bit holder.

* * * * *